US012480395B2

(12) United States Patent
Lafleur

(10) Patent No.: US 12,480,395 B2
(45) Date of Patent: Nov. 25, 2025

(54) MULTI-SENSOR ASSEMBLY

(71) Applicant: Halliburton Energy Services, Inc., Houston, TX (US)

(72) Inventor: Louis Francis Lafleur, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/645,938

(22) Filed: Apr. 25, 2024

(65) Prior Publication Data

US 2025/0334041 A1 Oct. 30, 2025

(51) Int. Cl.
*E21B 47/01* (2012.01)

(52) U.S. Cl.
CPC ..... *E21B 47/01* (2013.01)

(58) Field of Classification Search
CPC ..... E21B 47/01
See application file for complete search history.

(56) References Cited

U.S. PATENT DOCUMENTS

| | | | | |
|---|---|---|---|---|
| 6,888,972 | B2 | 5/2005 | Berg et al. | |
| 10,132,156 | B2 | 11/2018 | Leeflang et al. | |
| 2009/0033516 | A1* | 2/2009 | Alteirac | E21B 47/12 340/853.2 |
| 2014/0014337 | A1* | 1/2014 | Stringfield | E21B 43/04 166/278 |
| 2014/0041863 | A1* | 2/2014 | Dowling | E21B 34/06 166/250.01 |
| 2017/0268326 | A1* | 9/2017 | Tao | E21B 47/017 |
| 2018/0066513 | A1 | 3/2018 | Sugiura et al. | |
| 2018/0266236 | A1 | 9/2018 | Scogin et al. | |
| 2019/0169979 | A1* | 6/2019 | Nguyen | G01C 1/00 |
| 2020/0080413 | A1* | 3/2020 | Richards | E21B 47/06 |
| 2021/0071523 | A1 | 3/2021 | Siefert | |
| 2022/0136337 | A1 | 5/2022 | Lafleur | |
| 2022/0170812 | A1 | 6/2022 | Mckay et al. | |
| 2022/0186610 | A1* | 6/2022 | Loh | E21B 47/01 |
| 2022/0220818 | A1* | 7/2022 | Lafleur | E21B 47/01 |
| 2023/0167694 | A1 | 6/2023 | Leismer et al. | |
| 2023/0250706 | A1 | 8/2023 | Mair | |
| 2025/0047220 | A1 | 2/2025 | Wang et al. | |

FOREIGN PATENT DOCUMENTS

| | | |
|---|---|---|
| WO | 2014182290 | 11/2014 |

OTHER PUBLICATIONS

"PCT Application No. PCT/US2023/079745 International Search Report and Written Opinion", Apr. 2, 2024, 10 pages.
"U.S. Appl. No. 18/508,813 Non-Final Office Action", Mar. 26, 2025, 15 pages.

* cited by examiner

*Primary Examiner* — Caroline N Butcher
(74) *Attorney, Agent, or Firm* — DeLizio, Peacock, Lewin & Guerra LLP

(57) ABSTRACT

Embodiments of a multi-sensor apparatus for use downhole in a wellbore, a system, and a method for using a multi-sensor apparatus are disclosed herein. In one embodiment, an apparatus for use in a wellbore, comprises a manifold, the manifold having a plurality of ports; a housing connected with the manifold; at least three sensors positioned within the housing; and a first internal channel and a second internal channel for enabling fluid flow through the manifold. In another embodiment, a system includes a removable downhole tool and a multi-sensor apparatus coupled with the removable downhole tool.

19 Claims, 12 Drawing Sheets

MULTI-SENSOR ASSEMBLY

BACKGROUND

In some oil and gas production environments, it may be desirable to collect data from downhole sensors. In some examples, pressure may need to be monitored and applied to actuate downhole devices. For example, pressure may be applied via hydraulic control lines run from the surface to actuate downhole hydraulic devices. For completion operations, these hydraulic devices may be important for maintaining valves in specific positions as well as for monitoring the pressure in connected devices and control lines. In some wellbore operations, a potential for damage to the hydraulic lines may exist. The hydraulic control lines may be disposed externally on the production tubing while the completion is run in hole. This exposure may result in abrasion and the subsequent degradation of the hydraulic control lines as they descend down the wellbore.

Dual trip completions may pose an additional challenge as the lower completion is sometimes installed independently of the upper completion. In these operations, the lower completion may comprise the majority of the connected hydraulic control lines. As a result of this situation, it may be difficult to verify the integrity of the downhole hydraulic systems or the hydraulic control lines until the upper completion is installed later. If the hydraulic control lines have become damaged, repairs or replacement may be initiated resulting in a loss of productive time. The present invention provides improved apparatus and methods for monitoring and regulating pressure to downhole devices and hydraulic devices in completion operations, and also provide an apparatus that may be re-used to set up different downhole completions.

BRIEF DESCRIPTION

Reference is now made to the following descriptions taken in conjunction with the accompanying drawings, in which.

DETAILED DESCRIPTION

Figure 1:
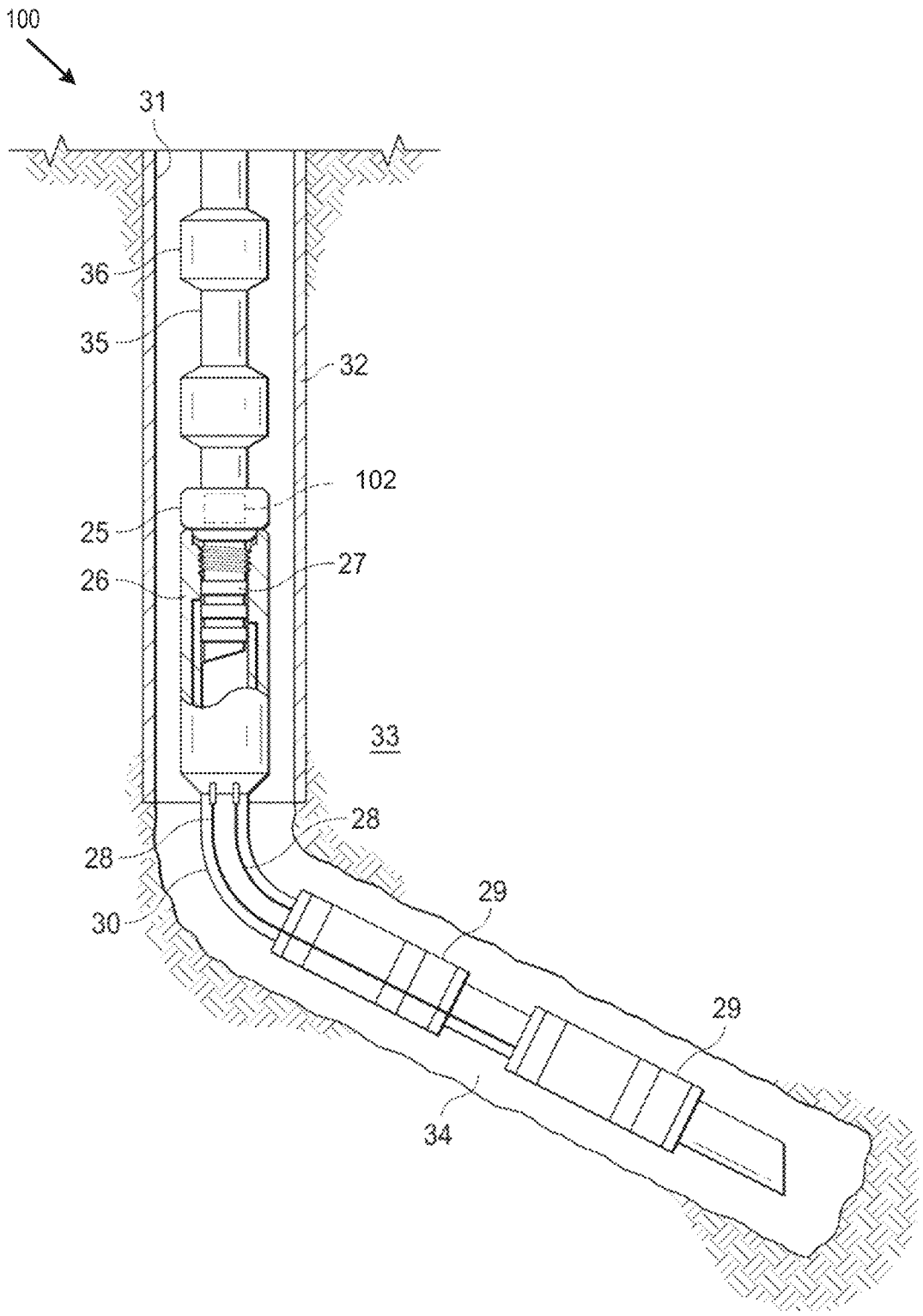
FIG. 1 is a diagrammatic illustration of an example well system, according to some implementations.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, at least about 99% met, or even at least about 100% met.

It is often most efficient to package pressure and/or temperature sensors into a downhole gauge or housing of a gauge for monitoring downhole (e.g., reservoir) pressures and/or temperatures, among other measurements. Historically downhole gauge packaging have been limited to two pressure/temperature sensor sets and have been installed as permanent downhole gauges. This design practice limits the downhole gauge to either both sensors monitoring the same pressure/temperature source (e.g., redundant measurement) or the downhole gauge can monitor two different pressure/temperature sources with two single sensors. Historically, in those situations where a third pressure source is desired, or redundant sensor sets for each pressure/temperature source is desired, one or more housings are added adjacent (e.g., radially offset and either axially aligned or axially offset, and coupled via a block splitter) thereto or there below (e.g., axially offset and radially offset or radially aligned) to obtain the additional pressure/temperature measurements. Adding sensors in this manner either requires the gauge mandrel, or other host tubular, to increase in outer diameter (OD) to protect the downhole gauge or the gauge mandrel, or the other host tubular to be considerably longer. Additionally, when downhole gauges are axially added together, a short segment of Tubing Encapsulated Conductor (TEC) is required to connect the downhole gauges. Each TEC connection adds a potential leak point to the downhole sensors and gauge assemblies, which is undesirable.

The present disclosure includes examples of a new multi-sensor assembly. The multi-sensor assembly combines multiple sensors into a single assembly. The assembly includes a housing connected with a manifold, wherein the manifold enables fluid flow through internal channels of the manifold connected with at least two of the sensors. All required sensors are positioned within a single assembly for use with various downhole systems, such as intelligent completion systems and dual trip integrity management. In dual-trip completions, an intelligent completion management system allows for remote wireless monitoring of the intelligent completions hydraulic and electric control lines while running in hole. After landing of the completion, the system monitors pressure and electrical continuity to confirm no damage occurred during deployment, prior to packer setting and releasing an upper assembly/running tool—without the need for surface control lines. Examples of the new multi-sensor assembly may also be removed with the running tool and be used again with another lower completion. This is an improvement over existing assemblies which require two or more pressure assemblies, each with two pressure sensors, and also other multi-gauge assemblies, which do not include a manifold or internal channels therein. Combining all sensors into a single assembly reduces potential leak paths between the sensor assembly and a subassembly such as an Electronics Connection Sub from 2 to 1. The reduced quantity of pressure sensor assemblies also allows for an additional module (such as, for one example, an additional battery module) to be connected to the Electronics Connection Sub. Once the lower completion has been set, the single multi-sensor assembly may be removed with the running tool, re-fitted, and used again, such as for setting up another downhole completion. Embodiments of the sensor assembly may be used with additional tools, such as acoustic data receiver for receiving commands from uphole. The sensor assembly may be used with various sizes and shapes of connection lines or tubing such that the sensor assembly may be configured for connection with various components and systems in various downhole systems and completions. The sensor assembly may be easily reconfigured and reused in additional downhole operations.

Benefits of the sensors all housed in a single assembly include eliminating potential pressure leak paths into an Electronics Connection Sub and/or enabling the connection of one or more additional electronic devices. In one example, a multi-sensor assembly includes 3 pressure sensors for applications where tubing pressure, annulus pressure and a chemical injection line pressure is monitored for applications where the interval control valve (ICV) is electrically actuated. The multi-sensor assembly simplifies hydraulic line routing by connecting a pressure compensator line and a tubing port line to ports on the multi-sensor assembly. Internally, pressure from each source would be ported to the appropriate transducer. A second set of ports enables fluid to flow through to the running tool to pressurize the chemical injection lines and to provide pressure to other devices such as a hydraulicly actuated release mechanism.

In some embodiments, a multi-sensor assembly may include four sensors. A configuration with four sensors may be used where the pressure compensator pressurizes the ICV and chemical injection lines. In this configuration the tubing port line is connected to the sensor assembly as described above. The Pressure Compensator is connected to a manifold of the multi-sensor assembly as described above and then to an external manifold, where the hydraulic pressure is split into internal channels for the ICV and Chemical Injection lines with one hydraulic line run back to the ports on the multi-sensor assembly to monitor ICV line pressure. The fourth sensor may be ported to the annulus via openings in the housing and one at least one communication channel through the housing near the pressure sensing.

Rotation of multi-the sensor assembly during the assembly process with another tool, such as the running tool, may lead to difficulty in routing, bending and/or terminating the hydraulic tubing/lines between pressure sources, sensor ports and the downstream devices. Adding alignment or support structure/blocks may substantially secure the orientation of the sensor assembly. With a known location of hydraulic ports on the multi-sensor assembly, precision bent tubing, including hydraulic tubing may be used to reduce challenges of assembling certain connections and configurations, such as pressure tight connections.

Pressure ports on previously existing multi-sensor assemblies require a Y-Block, manifold, or other component to allow fluid to flow past the sensor assembly while being monitored. Pressure sources connected to a sensor assembly or permanent downhole gauge are sometimes connected to a cavity where the diaphragm or bellows or other device is acted upon by the pressurized fluid and without a fluid conduit to another device, such as, e.g., a release mechanism, chemical injection valve or other device. Embodiments of the multi-sensor assembly disclosed herein may provide multiple improvements over previously available sensor or gauge assemblies. In one example, an electron beam welded sensor assembly may eliminate the need to replace o-ring seals after each use (O-ring testing is usually required to extend service interval beyond a single run). Elimination of service requirements to replace o-rings eliminates the need to remove transducers from their ports and/or the need to break the electrical connections. Elimination of service requirement to replace o-rings also eliminates the need to pressure test after rebuilding the sensor assembly. In one example, an integrated hermetic barrier with electrical feedthroughs maintains vacuum pressure, or gas fill of the electronics chamber, and a controlled atmosphere inside of the sensor assembly which minimizes the potential for errant readings or complete sensor failure. The location of the sensor assembly ports relative to the tool on embodiments disclosed herein may also accommodate different tubing diameter sizes (e.g., 3½ in, 4½ in, and 5½ in).

Referring now to FIG. 1, there is shown one embodiment of a well system 100, including a sensor assembly 102 having at least three sensors that is designed, manufactured and/or operated according to one embodiment of the disclosure. The sensor assembly 102 may be part of or coupled with a running tool 25. A wellbore 31 may comprise well casing 32 which penetrates subterranean formation 33. The wellbore 31 may also comprise an open hole section 34 which lacks casing 32 and is where a lower completion 30 may enter the subterranean formation 33 without the well structure formed by casing 32. The upper completion 35 may comprise tubing, drill/base pipe, or another conduit coupled to the running tool 25. The upper completion 35 may also comprise wireless telemetry modules 36 to transfer information to or from the sensor assembly 102 to the surface. The running tool 25 is anchored to the lower completion hydraulic receptacle 26 prior to entering the wellbore 31 or is later inserted into the wellbore 31 to engage with the lower completion hydraulic receptacle 26. The sensor assembly 102 may include a plurality of ports for connection with other downhole devices and systems as will be described herein.

The sensor assembly 102, in the illustrated embodiment, is deployed within a wellbore 115, e.g., a well for the production of oil, natural gas, water, or another subterranean resource. Each sensor of the sensor assembly 102 may be used to collect data related to at least one of a pressure and/or a temperature, among others, at a particular location within the wellbore 31. For example, each sensor of the sensor assembly 102 may collect data relating to conditions within a string of tubular components (e.g., a production string) positioned in the wellbore 31, data relating to conditions in an annulus between the string and the wellbore 31 itself, or combinations thereof, again among others. In some embodiments, the sensor assembly 102 may be in direct communication with an interior of the production string in the wellbore 31 (e.g., in direct communication with pressure and/or temperature inside the production string via the apertures). Data from each sensor may be combined to provide information about a pressure and/or temperature profile within the wellbore 31 or along a length of the wellbore 31.

One example of a connected downhole system may include hydraulic devices 29. The assembly 102 may connect with a hydraulic receptacle 26 and hydraulic seals 27 that route hydraulic pressure to connected hydraulic devices 29 via control lines 28 in the lower completion 30. The sensor assembly 102 may be used in the setting of various systems and devices within the lower completion 30. Once the systems or devices are set, the running tool 25 may be removed from the wellbore 31. Once removed, the sensor assembly 102 may be reconfigured and used again to deploy one or more systems or tools in a different wellbore needing a same or different completion configuration.

Figure 2:
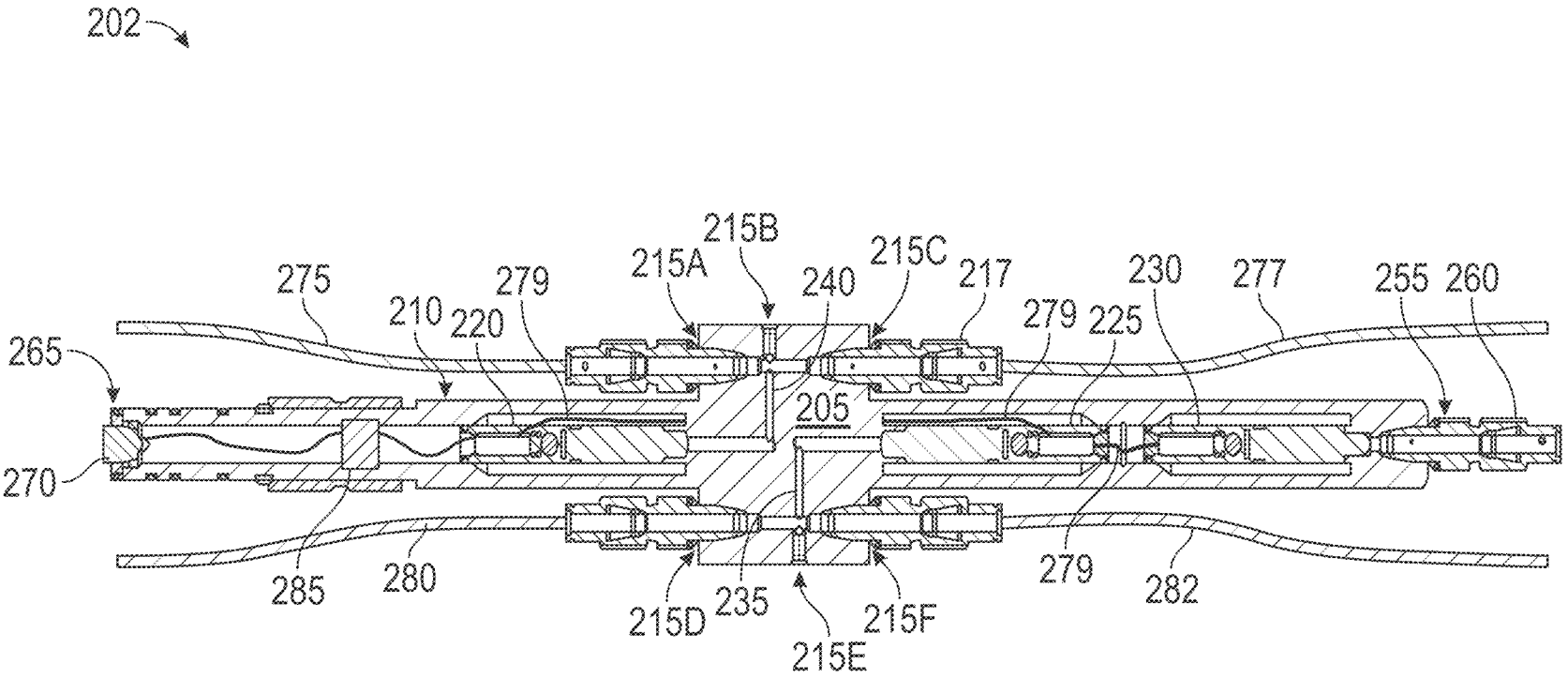
FIG. 2 illustrates one embodiment of a multi-sensor assembly, according to some implementations.
Figure 3A:
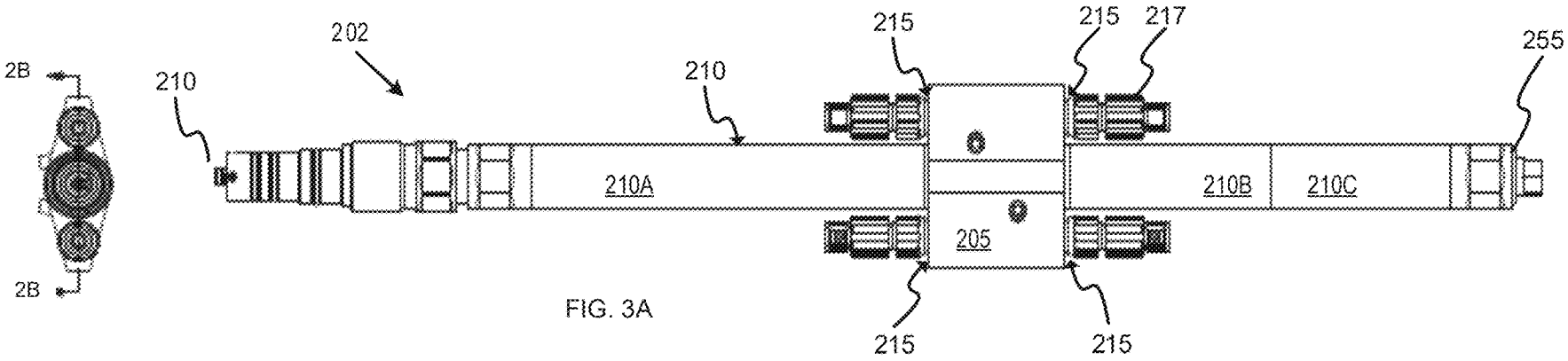
FIGS. 3A and 3B illustrate different views of the multi-sensor assembly of FIG. 2, according to some implementations.
Figure 3B:
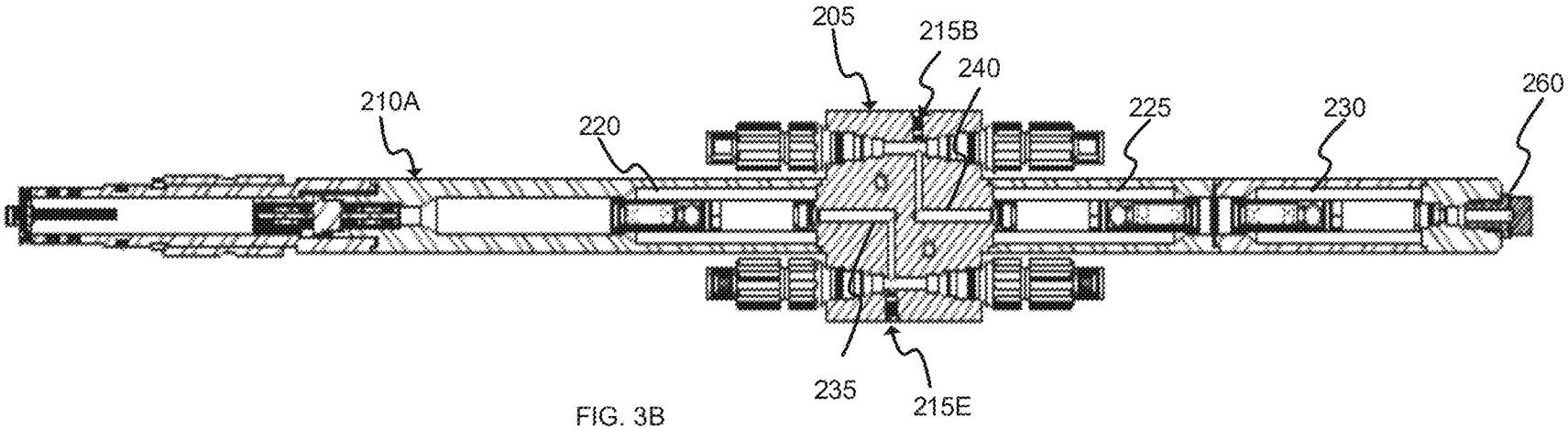

Referring now to FIG. 2, 3A, and FIG. 3B. FIG. 2 is shown an interior view of a multi-pressure assembly 202 for use in a wellbore. FIGS. 3A and 3B are top and section views of the assembly 202. The assembly 202 includes a manifold 205 with a housing 210 coupled thereto. In this embodiment, the housing 210 includes portions 210A, 210B, and 210C coupled on opposing sides of the manifold 205. The manifold 205 includes a plurality of ports 215 (shown as 215A, 215B, 215C, 215D, 215E, and 215F) for receiving connectors, plugs, or fluid lines connected with other downhole devices. Each of the ports 215 may be configured to receive a connector, such as connectors 217, such as a high performance cable, tubing termination with a sealing arrangement, cone and thread fittings, or a compression seal (such as, e.g. Halliburton's FMJ intelligent completion connector). Each connector or cable termination may incorporate a pressure-testable dual metal-to-metal ferrule seal arrangement for isolating a downhole cable outer metal sheath from a well fluid. Some embodiments may include additional ports in addition to those shown in this example. Ports 215B and 215E may have removable plugs instead of connectors installed thereon.

The housing 210 portions may each include at least one sensor. In this embodiment, there are at least three sensors. The sensors may be used for a variety of different purposes and may include at least pressure and/or temperature sensors. In this example, the sensors are pressure sensors and include a tubing pressure sensor 220 positioned in housing portion 210A, a downhole hydraulic device sensor 225, such as a chemical injection pressure sensor, positioned in housing portion 210B, and an annulus pressure sensor 230 positioned in housing portion 210C. The sensors may be arranged in various configurations within the housing 210 and remain within the scope of the disclosure. In some embodiments, the sensors may include a water cut sensor, phase change sensor (e.g., steam break-through sensor), an accelerometer (e.g., vibration sensor) or gyroscope (e.g., orientation sensor). In yet another embodiment, sensors may include a $CO_2$, $H_2$ or $H_2S$ sensor, among others. The sensors should not be limited to any specific sensor, and thus may include many different types of sensors.

The manifold 205 may include at least a first internal channel 235 and a second internal channel 240. The first and second channels 235, 240 enable fluid flow through the manifold 205 between the plurality of ports 215 and at least two of the sensors 220, 225, and 230. The first channel 235 and second channel 240 also communicatively connect the sensors 220, 225, and 230 to other devices, systems, or control lines and/or the wellbore annulus external to the assembly 202 via the plurality of ports 215. Other embodiments described herein may include more sensors which may be arranged in different configurations. In some examples, there may be up to six sensors.

The housing 210 may have a port 255 at a downhole end, in this example a downhole end of portion 210C. A plug 260 may be positioned in the port 255. The plug 260 may include a screen or filter therein to prevent debris from entering the housing 210 and interfering with the function of the diaphragm or bellows of the annulus pressure monitoring transducer of the annulus pressure sensor 230, while allowing annulus pressure to enter the housing.

The plurality of ports 215 and ports in the housing 210 may connect the assembly with other systems and devices. In this example, the housing 210 may include a port 265 at an uphole end of portion 210A. The uphole port 265 may include a connector 270 for coupling the assembly with another downhole device or a subassembly, such as an electronics sub of a running tool. Tubing pressure may be routed to another device positioned on a downhole tool, such as a running tool. In this example, tubing pressure may be routed from the tubing pressure sensor 220 to a tubing pressure release system via second channel 240 coupled inline with at least a first external line 275, a tubing pressure line. Second channel 240 may also be connected with a second external line 277 directed to a release system, such as a hydraulic release system. The chemical injection pressure sensor 225 may be connected via first channel 235 with a third external line 280, which may connect with a pressure compensator and fourth external line 282 to chemical injection lines. In this embodiment, there are electrical lines 279 shown within the manifold connected with each of the sensors 220, 225, and 230.

The assembly 202 may also include a hermetic barrier 285. The hermetic barrier 285 may provide electrical feedthrough and maintain a vacuum pressure, or gas fill pressure and controlled atmosphere within the assembly 202, which minimizes the potential for errant readings or complete sensor failure. This feature is extremely beneficial for a service tool which may be run/redressed multiple times and may remain in a regional operations base inventory.

Figure 4A:
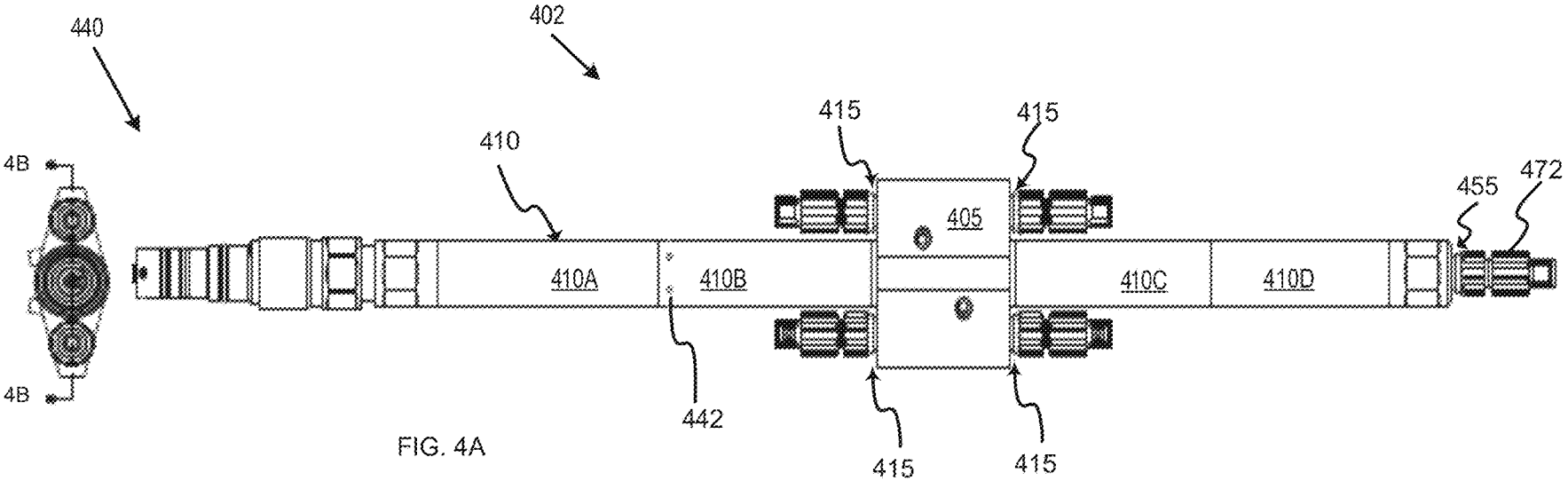
FIGS. 4A and 4B illustrate different views of another embodiment of a multi-sensor assembly, according to some implementations.
Figure 4B:
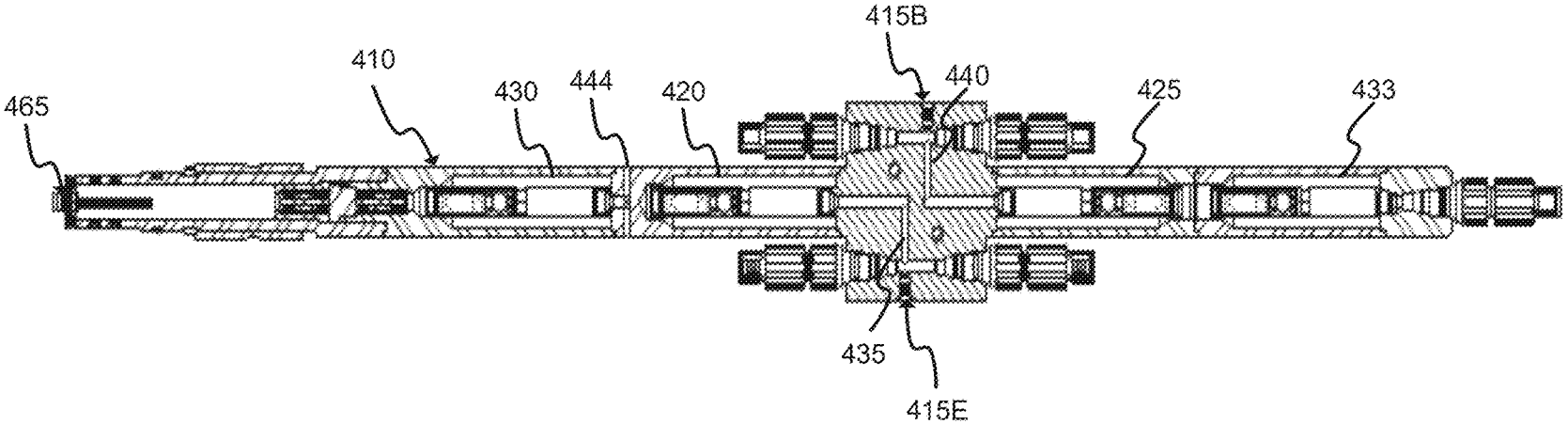

Referring now to FIGS. 4A and 4B, there is a top and section view of multi-sensor assembly 402 shown used in conjunction with base pipes of different diameter sizes. Sensor assembly 402 is similar to sensor assembly 202 described and illustrated in FIGS. 2-3B and like reference numerals are used to describe similar features. The assembly 402 differs, for the most part, in that the assembly 402 includes four sensors and also four housing portions, 410A-410D. In this example, the four sensors include a tubing pressure sensor 420 positioned in housing portion 410B, a chemical injection pressure sensor 425 positioned in housing portion 410C, an annulus pressure sensor 430 positioned in housing portion 410A, and an ICV pressure sensor 433 positioned in housing portion 410D. The sensors may be arranged in various configurations within the housing 410 and remain within the scope of the disclosure. In this example, the annulus pressure sensor 430 is positioned in housing portion 410A between the manifold 405 and a port 465 at an uphole end of the housing 410, rather than adjacent a plug. The housing 410 may include holes 442 or orifices in its outer diameter (OD) to allow annulus pressure to enter the housing 410. A channel 444 may connect the holes 442 with the annulus pressure sensor 430.

In this embodiment, a port 455 at a downhole end receives a connector 472 with a line 474 for connecting the ICV sensor 433 with an ICV, such as a hydraulically activated ICV, positioned downhole of the assembly 402.

In some embodiments, a fifth sensor, such as a vibration sensor may also be positioned within the housing 410. And other embodiments may include a sixth sensor. In embodiments where an additional sensor, such as a vibration sensor or gyroscope, does not require contact with fluid, the sensor may be positioned between two sensors, such as between chemical injection pressure sensor 425 and an ICV pressure sensor 433, or between annulus pressure sensor 430 and tubing pressure sensor 420. An additional sensor that requires contact with fluid may similarly be incorporated two or the sensors, but require an additional port, similar to annulus port 444 to be incorporated into housing 410.

Embodiments of a single multi-sensor assembly with at least 3-4 sensors, such as assembly 202 and 402 reduce potential leak paths compared to 2 sensor assemblies with 2 sensors each that must be coupled or together. The single multi-sensor assembly also enables connection of an additional electrical device, or battery, to an electrical connection sub of a removable or running tool. A dual trip running tool may be configured for intelligent completion systems which monitor system integrity, including hydraulic and chemical injection lines.

The multi-sensor assembly may reduce costs for certain downhole assemblies—less inventory of individual sensors will be needed to stock a regional operations base inventory. The assembly may provide improved service life and reduced maintenance, which may also help reduce costs. Pressure ports, such as ports 215 and 415 enable fluid flow to downstream devices which may simplify line routing and termination, including hydraulic line routing, and eliminate the need for hydraulic manifolds, such as e.g. Y-block manifolds, eliminating potential leak paths.

The fixed location of the sensor assembly and therefore the connection ports 215 and 415 enable tubing and lines to be more easily configurable or adjustable, and reduces the number of electrical connections needed between the sensor assemblies and a downhole network interface unit (e.g., reducing the number of require wires from 8 to 4 in assembly 402). Design and manufacture of Computer numerical control (CNC) bent hydraulic lines may improve assembly and re-assembly once the multi-sensor has been run and redressed (which includes disassembly, clean, inspect, function test, replace consumable items such as pressure fittings, etc, and return to inventory for future re-use). The assembly may be re-used as-is, or may be reconfigured for use with other projects or applications. Assembly repeatability may also be achieved with the use of precision bent hydraulic lines such that individual assembly technicians no longer need to determine how to bend and route hydraulic lines on unique assemblies to make everything fit within a required inner diameter (ID) space for use downhole.

Figure 5:
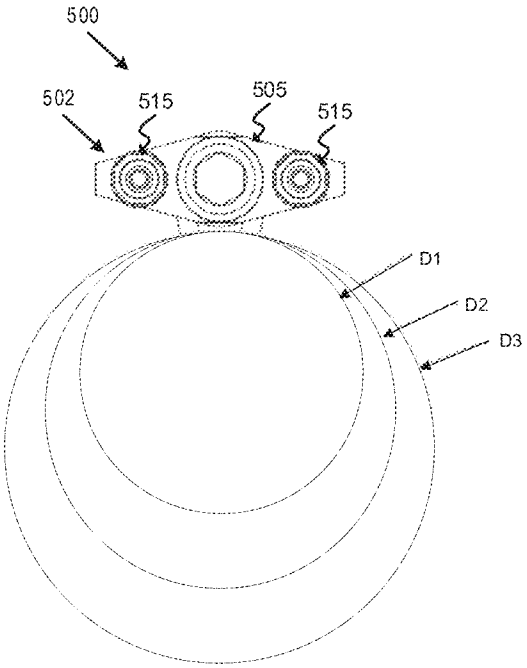
FIG. 5 is an end view of a multi-sensor assembly relative to example sizes of base-pipes, according to some implementations.

Referring now to FIG. 5, there is shown an end view of multi-sensor assembly 502 shown used in conjunction with base pipes of different diameter sizes. Sensor assembly 502 is similar to sensor assembly 202 described and illustrated in FIGS. 2-4B and like reference numerals are used to describe similar features. The location of sensor assembly ports 515 relative to other downhole tools and connections in embodiments disclosed herein may also accommodate different base pipe diameter sizes, such as D1, D2, and D3, which may be, for example 3½ in., 4½ in., and 5½ in. respectively.

Figure 6A:
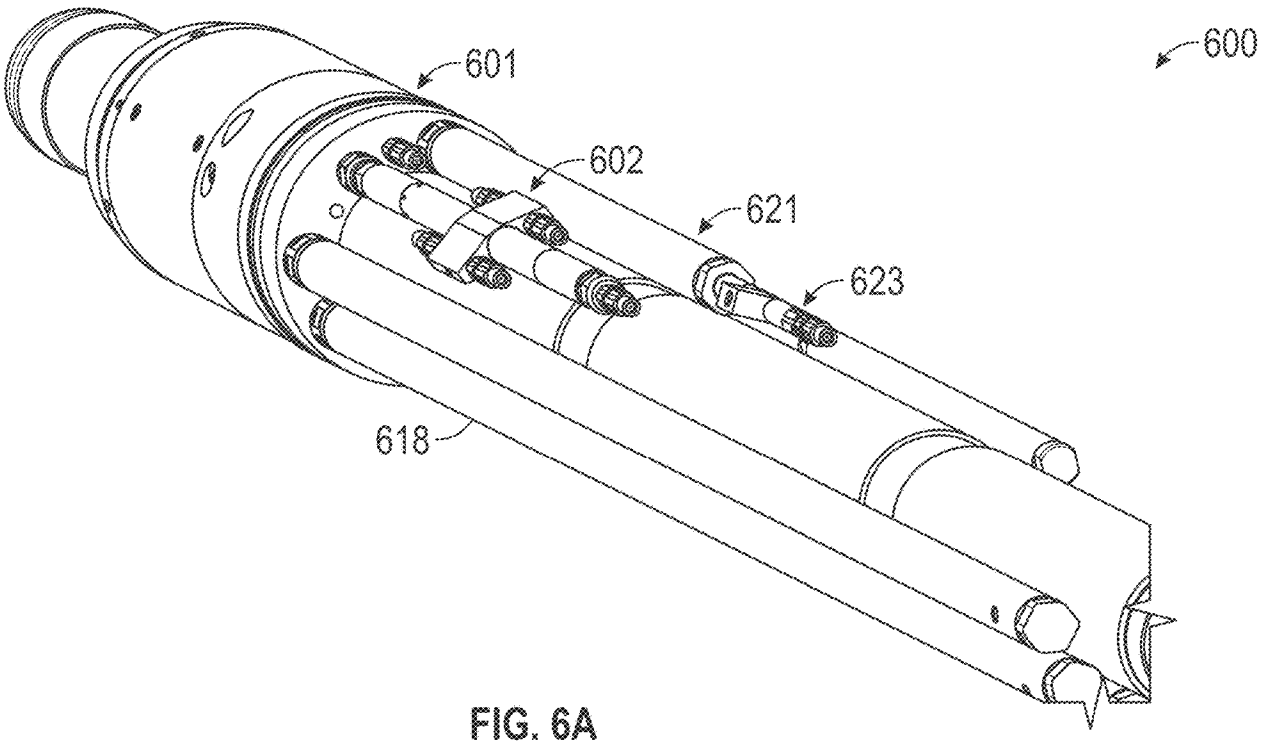
FIG. 6A-6B illustrate one embodiment of a completion system having a multi-sensor assembly, according to some implementations.
Figure 6B:
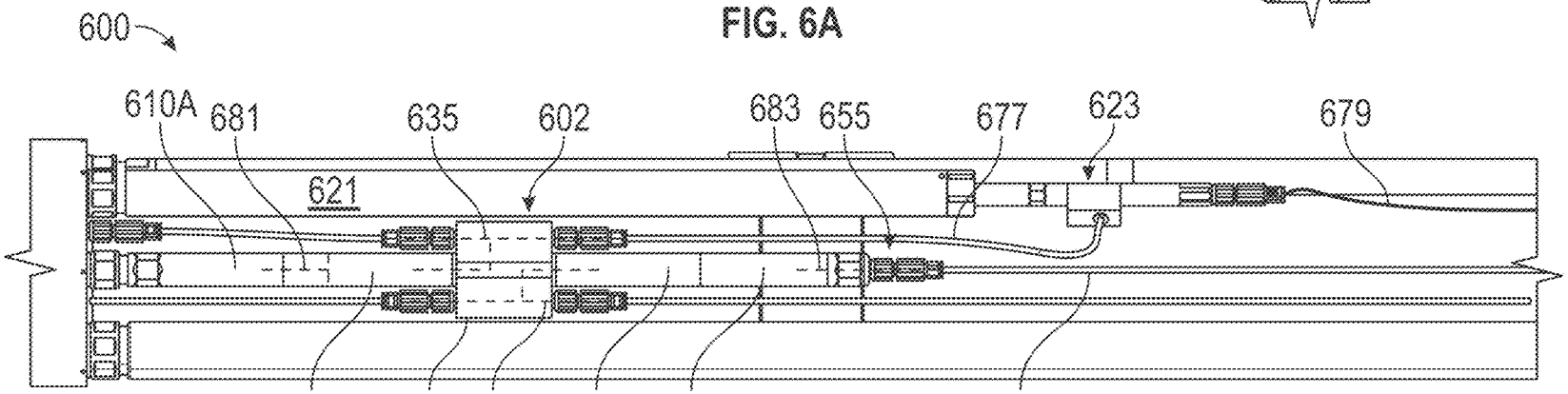

Referring now to FIG. 6, there is shown a multi-sensor assembly 602 shown as part of a removable completion system 600. The assembly 602 is similar in many respects to the assembly 402 shown in FIGS. 4A and 4B. Accordingly, like reference numbers have been used to indicate similar, if not identical, features. The assembly 602 differs, for the most part, in that the assembly 602 is shown coupled with an electronics sub 601 of completion tool and is positioned external to a base pipe 603 connection which may be part of a downhole completion system. The electronics sub 601 may also have one or more batteries 618 coupled thereto for supplying power to the completion tool. Although not shown, the assembly and other features external to the base pipe may be covered by a screen or cage. The screen or cage may be constructed of metals and protect the pressure assembly and other components while enabling pressure and fluid to engage the assembly. In this example, the downhole assembly may include a downhole control module 621 and an electronic trigger for the hydraulic release system 623. The assembly 602 may communicate with a control unit positioned within or on the surface of the wellbore and may be used to activate the electronic trigger of the hydraulic release system 623 based on readings from the three or more sensors of the assembly or based on a command from the surface control system. The downhole control module 621 in this example communicates with the surface, the downhole sensors and the electronic trigger for the hydraulic release system 623. In some examples, the downhole control module 621 communicates with the surface either wirelessly or via a TEC connection.

In this embodiment, channel 635 may be communicatively coupled with at least a tubing pressure sensor and external line 675 to convey tubing pressure and 677, which may connect with the electronically triggered hydraulic release system 623. External line 679 may convey tubing pressure from the hydraulic release system 623 further downhole in the completion. An annulus pressure sensor may be positioned in housing portion 610A between the manifold 605 and the electronics sub 601. An external hydraulic manifold splits to pressurize the chemical injection lines and the ICV lines. The ICV line may be hydraulically coupled with external line 684. Channel 640 may be communicatively coupled with at least a chemical injection pressure sensor in housing portion 610C and be communicatively coupled with external line 682 which may be a chemical injection line. An ICV pressure sensor is positioned in housing portion 610D and be connected through port 655 with an external line 684 which may then connect with one or more ICV valves downhole within the completion system.

Figure 7A:
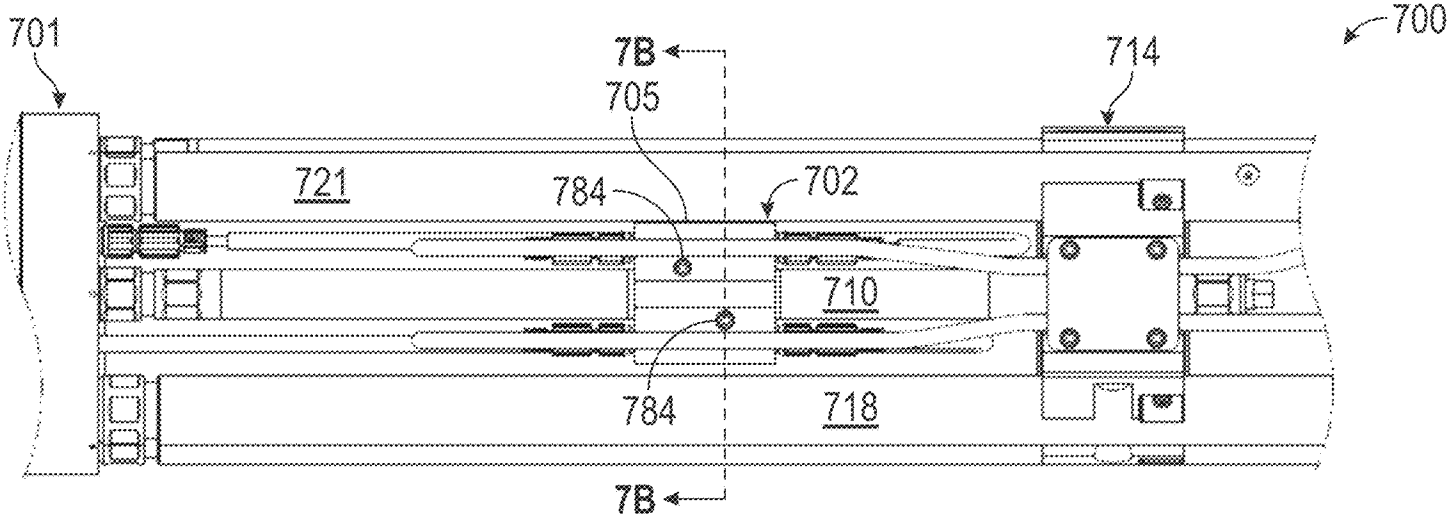
FIG. 7A-7C illustrate different views of a completion system having a multi-sensor assembly, according to some implementations.
Figure 7C:
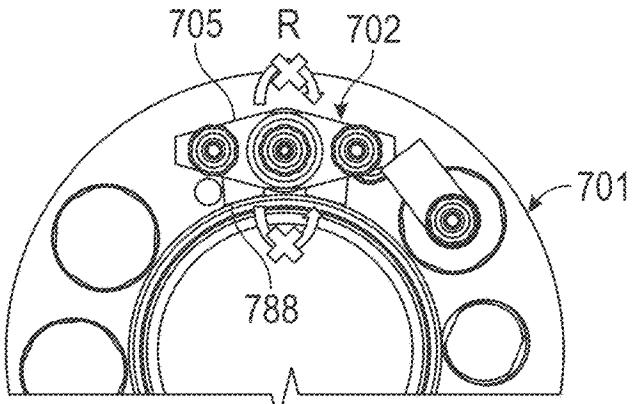
Figure 7B:
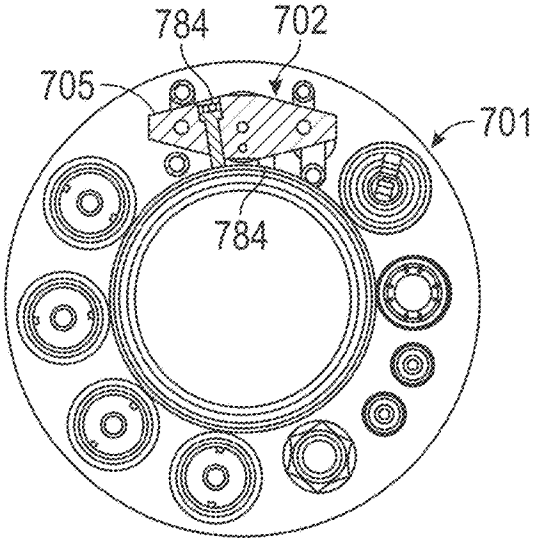

Referring now to FIG. 7A-7C, there is shown a system 700 having a multi-sensor assembly 702. The assembly 702 is similar in many respects to the assembly 202, 402, 502, and 602 shown in FIG. 2-6. Accordingly, like reference numbers have been used to indicate similar, if not identical, features. The assembly 702 is shown coupled with an electronics subassembly 701 of a running tool and positioned about a base pipe 703. FIG. 7A illustrates the various flexible and bendable tubing and hydraulic lines that may be used with the assembly 702. The system 700 may include a support structure or bracket 714 for supporting one or more components of the system 700. In this example the support structure 714 is supporting at least a portion of the housing 710 and at least one battery 718 which may provide power for the system 700. The support structure 714 helps maintain the positioning of the assembly 702 and other components of the system 700 while being run in hole. The system, in some embodiments, may include a downhole control module 721 for battery powered embodiments. For embodiments connected to the surface by electrical/data lines, batteries and the downhole control module may not be required.

FIGS. 7B and 7C illustrate possible features and a method to prevent the sensor assembly 702 from rotating (R) during make-up or attaching to a subassembly, or by the addition of fasteners, such as e.g., socket head cap screws, that may be implemented to facilitate the use of precision bent hydraulic lines. In FIG. 7B, a fastener 784, such as a screw is placed through the manifold 705. The manifold 705 has threads in the holes so the fasteners 784 or screws can be threaded appropriately for different sizes of base pipe as shown in FIG. 5. In FIG. 7C, a spacer or wedge 788 is placed beneath the manifold 705. The spacer or wedge 788 may also be implemented as a clamp. Rotation R of the assembly 702 is substantially prevented such that the rotation of the wedge is less than about 5 mm in either direction.

Figure 8A:
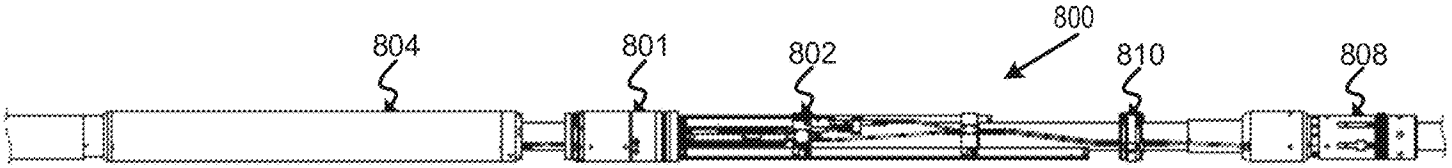
FIG. 8A-8C illustrate different views of another embodiment of a completion system having a multi-sensor assembly, according to some implementations.
Figure 8B:
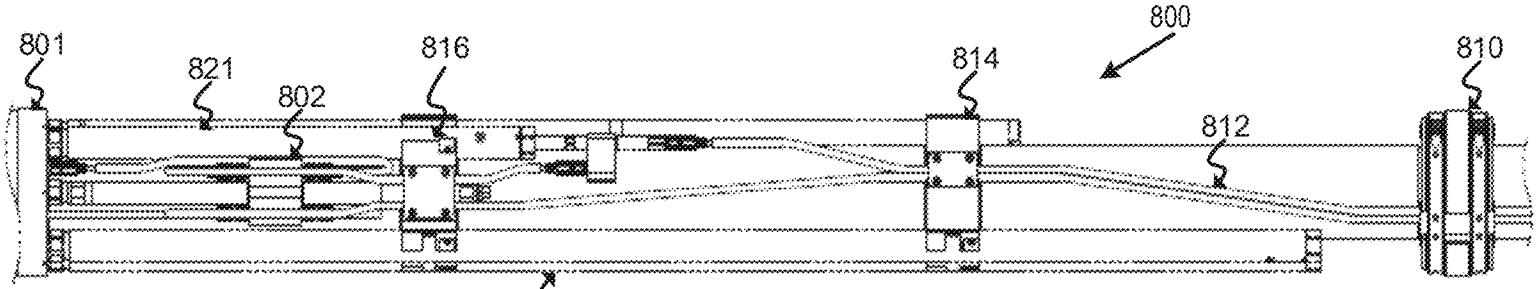
Figure 8C:
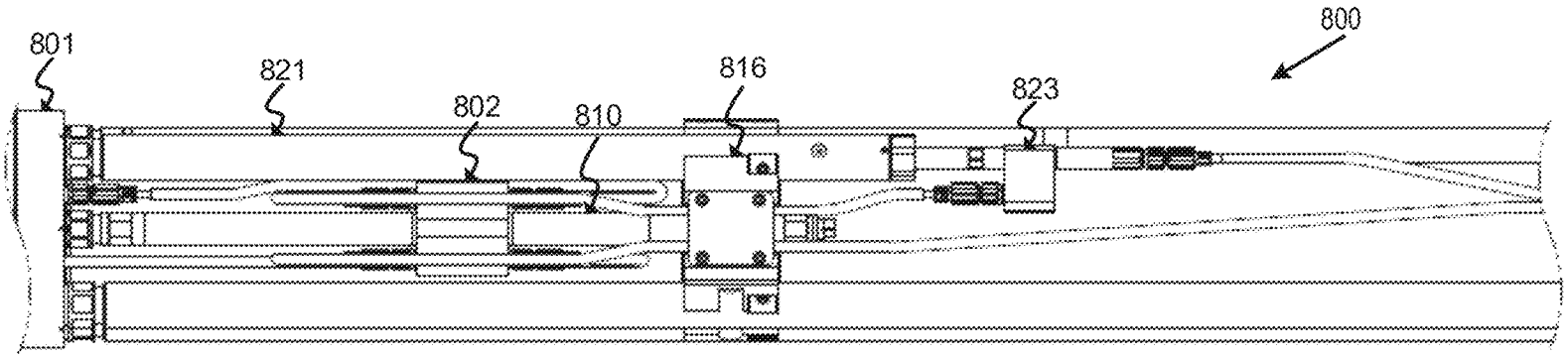

FIG. 8A-8C are side views of an example completion tool system 800 having a multi-sensor assembly 802. The system 800 may include a pressure compensator 804 at an uphole end with an electronic subassembly 801. A pressure release system 808 may be coupled at a downhole end. A bottom sub 810 may receive a plurality of lines and tubing 812. At least a first support or bracket 814 may support one or more of the lines and tubing connected with the multi-sensor assembly 802 and other components of the system. At least a second support or bracket 816 may be positioned proximate the sensor assembly 802 and may be used to support at least a portion of the housing above a base pipe. The system may also include a downhole control module 821 for communicating with the surface and the sensors. The system may also include one or more batteries 818 for powering the system 800, but in some embodiments, the system may be connected with an uphole power source. The system 800 is connected with a trigger of pressure release system 823. This entire assembly may be mated to a wet mate receptacle which is the top most component of a lower completion. Below the receptacle is a packer which provides a pressure barrier between the upper and lower completions and is anchored to the casing which supports the weight of the lower completion. At least one ICV may be positioned below the packer.

Figure 9A:
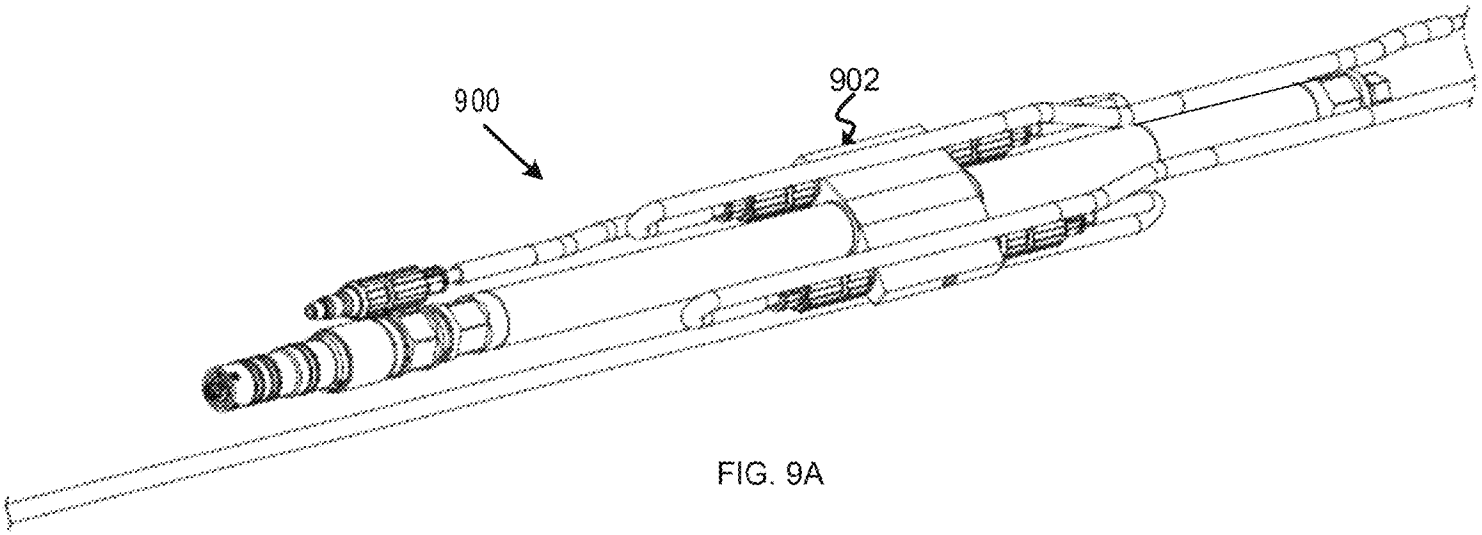
FIG. 9A-9E illustrate different views of another embodiment of a multi-sensor assembly and connection lines, according to some implementations.
Figure 9B:
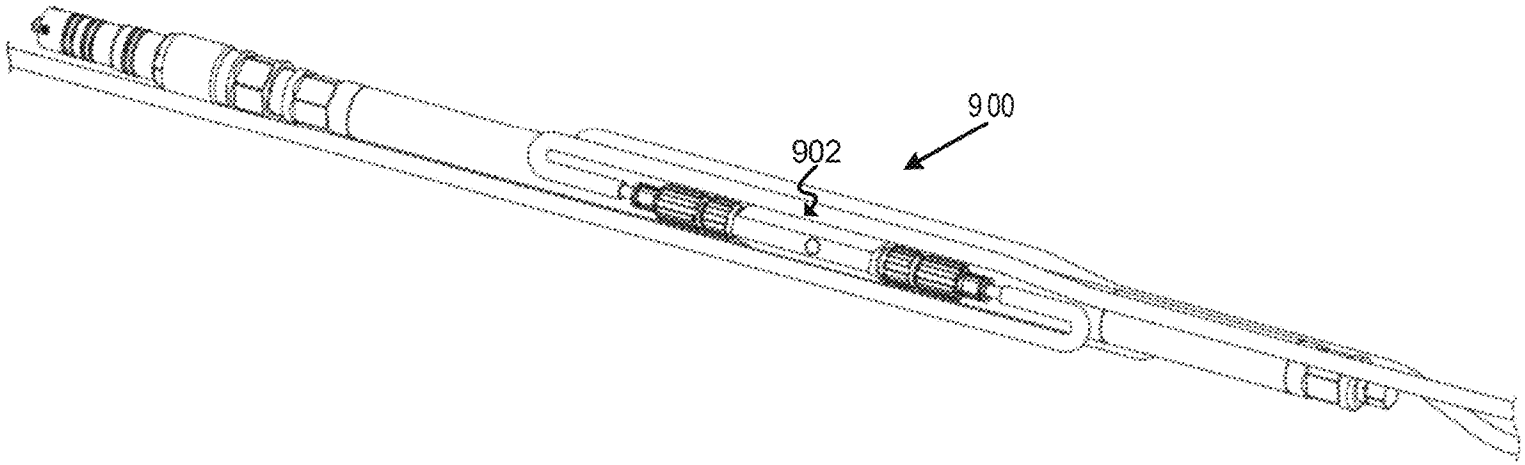
Figure 9C:
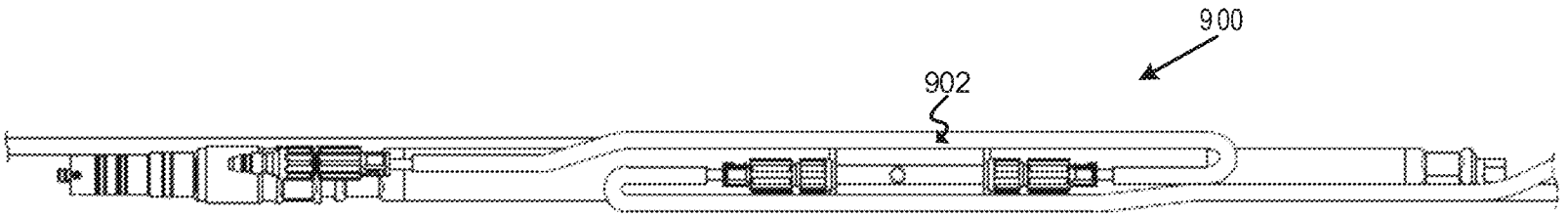
Figure 9D:
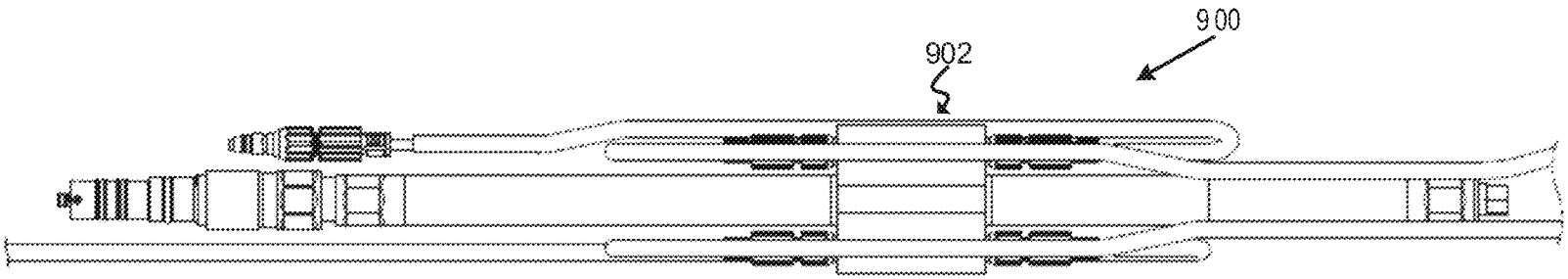
Figure 9E:
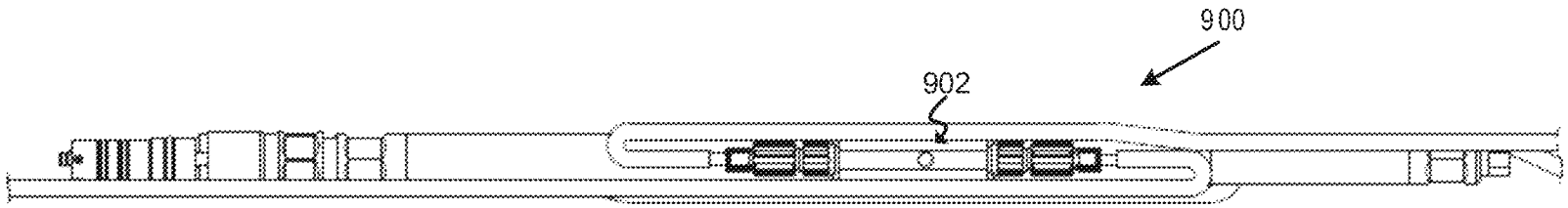

FIG. 9A-9E illustrate different views of a system 900 with a multi-sensor assembly 902 installed thereon. FIG. 9A is a top perspective view of the multi-sensor assembly having a plurality of tubing connected thereto. FIG. 9B is a bottom perspective view. FIG. 9C is a first side view, FIG. 9D is a top view, and FIG. 9E is a second side view. These various views illustrate the design flexibility provided by the multi-sensor assembly 902 such that various tubing lengths, bends, and flexibilities may be used to connect the multi-sensor assembly 902 with one or more downhole tools and systems.

Figure 10:
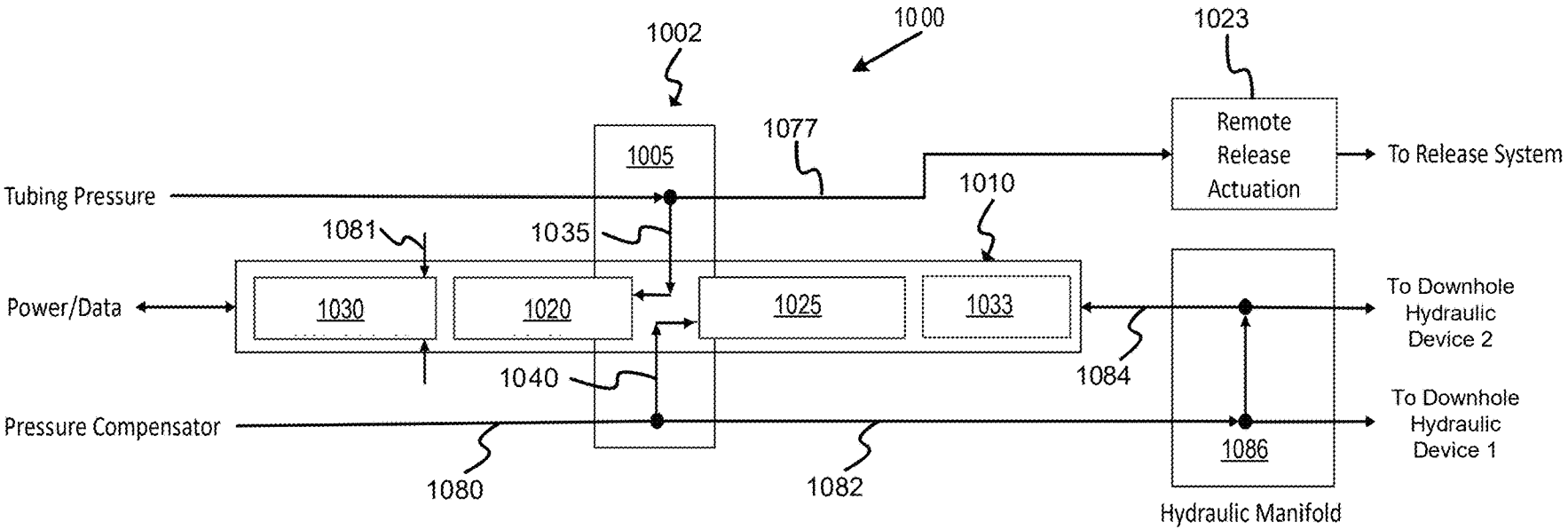
FIG. 10 is a system drawing illustrating one example of a multi-sensor assembly interconnected with downhole devices, according to some implementations.

FIG. 10 is a system diagram illustrating a system 1000 having a multi-sensor assembly 1002 shown connected with two or more downhole devices. The multi-sensor assembly 1002 is similar to the assemblies 402 and 602 comprising at least four sensors within housing 1010 and connected with manifold 1005. Annulus pressure may enter through channel 1081 to an annulus pressure sensor 1030. Channel 1035 may fluidly connect tubing pressure with a tubing pressure sensor 1020. Similar to system 600, external line 1077 connects assembly 1002 with a remote release actuation device 1023.

Housing 1010 may also include pressure sensors 1025 and 1033. Sensor 1025 may be a first downhole hydraulic device pressure sensor 1025. In some systems, the first hydraulic device may a chemical injection device and the first downhole hydraulic device pressure sensor 1025 is a chemical injection pressure sensor. Sensor 1033 may be a second downhole hydraulic device pressure sensor. In some systems, the second hydraulic device may be an ICV and the second downhole hydraulic device pressure sensor 1033 is an ICV pressure sensor. Line 1080 comes from a pressure compensation sub located uphole of the assembly 1002 (not shown). Line 1080 is connected to manifold 1005 with hydraulic communication via channel 1040 to housing 1010 and to line 1082 which connects to an external hydraulic manifold 1086 to split the pressurized fluid to chemical injection and ICV lines. The ICV line is hydraulically coupled to 1084. The hydraulic manifold 1086 may have check valves internally to facilitate splitting the single pressure from the pressure compensator into two hydraulic channels which can be monitored independently and pressure relief valves to protect downhole hydraulic devices from overpressure, which may be due to thermal expansion of fluid in the 1000 system as the tool is run deeper in the well and heats up.

Accordingly, any of the multi-sensor assemblies 202-1002 may be rated for pressures greater than 1000 Bar (e.g., greater than approximately 15K psi), including being rated for pressures above 1702 Bar (e.g., greater than approximately 25K psi) and/or above 2402 Bar (e.g., greater than approximately 35K psi). The manifold and housing of each assembly may be constructed with metals suitable to withstand these pressures and downhole conditions.

Figure 11:
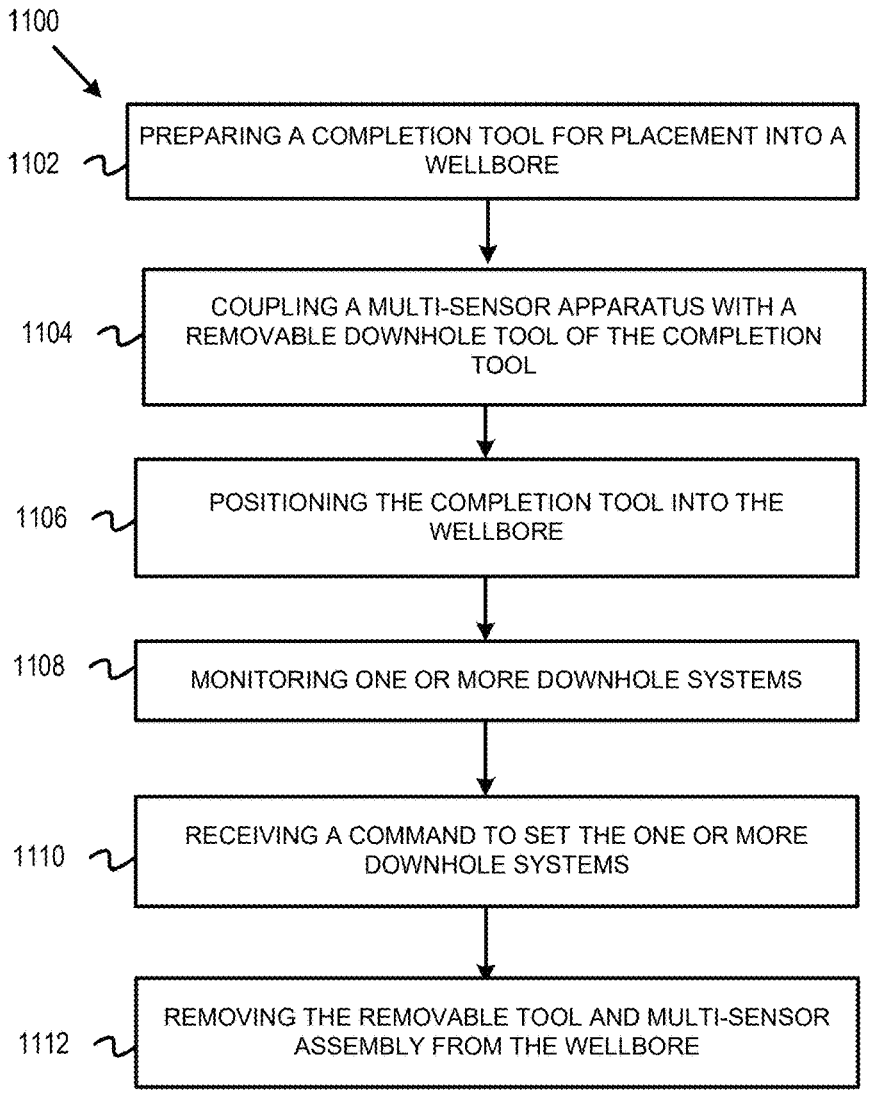
FIG. 11 is a flowchart depicting a method, according to some implementations.

FIG. 11 illustrates a method 1100 for using embodiments of a multi-sensor assembly described herein. In this example, the multi-sensor assembly is described with a removable tool, such as a running tool, used for setting downhole completion systems having one or more downhole tools. The method begins at a block 1102 wherein a completion tool is prepared for placement into a wellbore extending through one or more subterranean formations, The completion tool may include at least one a removable tool, such as e.g. a running tool.

At a block 1104, a multi-sensor apparatus, such as any of assemblies 202-902, are coupled with the completion tool.

At a block 1106, the completion tool is positioned within a wellbore. In some implementations, the completion tool may be coupled with a lower completion tool or system.

At a block 1108, the multi-sensor apparatus is used to monitor one or more downhole systems in the wellbore.

At a block 1110, at least one command from a control unit is received by the completion tool to set one or more of the downhole systems in the wellbore. The signal may be received via an electronics sub of the running tool, or another communication module of the running tool.

At a block 1112, the removable tool and multi-sensor assembly are pulled uphole and removed from the wellbore. The multi-sensor assembly may then be reconfigured and used in another downhole deployment.

A multi-sensor assembly according to the present disclosure has many benefits. For example, a multi-sensor assembly/apparatus may include three or more sensors (e.g., three or more pressure and/or temperature sensors) minimizes TEC terminations, minimizes downhole gauge length (e.g., versus adding downhole sensors or gauges below), minimizes potential leak paths, is able to be used with flexible tubing/lines, and enables the sensor assembly to be removed with the running tool to be reconfigured at a surface of the wellbore and used again for setting a other downhole completion. The multi-sensor assembly disclosed herein also minimizes downhole sensor "footprint" on or below the running tool. Similarly, the stand alone manifold of the sensor assembly is able to be pressurized and maintain tubing pressure. The internal channels within the manifold enable fluid flow through the manifold and fluid flow between the sensors and other downhole devices or systems and/or the wellbore annulus.

Multiple ports parallel to the sensor assembly allow fluids to flow through the sensor assembly and to the sensors/pressure transducers within. Ports may be angled in some examples. A hermetic barrier within the sensor assembly may maintain a controlled atmosphere inside sensor assembly. Further, anti-rotation/alignment features may allow standardize bending and routing of hydraulic lines. The multi-sensor assembly may also be used or routed for various downhole devices. Furthermore, the multi-sensor assembly provides additional monitoring capabilities, reduced complexity (e.g., versus installing separate tool(s)) and reduces potential leak paths. Likewise, the multi-sensor assembly is configured such that additional sensors may be coupled or added thereto, enables a TEC feedthrough, enables multi-drop capability.

Aspects disclosed herein include:

Aspect A: An apparatus for use in a wellbore, comprising: a manifold, the manifold having a plurality of ports; a housing connected with the manifold; at least three sensors positioned within the housing; and a first internal channel and a second internal channel for enabling fluid flow through the manifold.

Aspect B: A system, comprising: a removable downhole tool to be run into a wellbore extending through one or more subterranean formations; and a multi-sensor apparatus coupled with the removable downhole tool, the multi-sensor apparatus including: a manifold, the manifold having a plurality of ports; a housing connected with the manifold; at least three sensors positioned within the housing; and a first internal channel and a second internal channel for enabling fluid flow through the manifold.

Aspect C: A method, comprising: preparing a completion tool for placement into a wellbore extending through one or more subterranean formations, the completion tool including a removable tool; coupling a multi-sensor apparatus with the completion tool, the sensor apparatus including: a manifold, the manifold having a plurality of ports; a housing connected with the manifold; at least three sensors positioned within the housing; and a first internal channel and a second internal channel for enabling fluid flow through the manifold; monitoring, by the multi-sensor apparatus, one or more downhole tools in the wellbore; receiving at least one command from a control unit to set the one or more downhole tools; and removing the removable tool and multi-sensor assembly from the wellbore.

Aspects A, B, and C may have one or more of the following additional elements in combination:

Element 1: wherein the at least three sensors include a tubing pressure sensor, an annulus pressure sensor, and a first downhole hydraulic device pressure sensor.

Element 2: wherein the first internal channel connects two or more of the plurality of ports with a first sensor of the at least three sensors and the second internal channel connects two or more of the plurality of ports with a second sensor of the at least three sensors.

Element 3: wherein the housing includes at least a first portion on one side of the manifold and at least a second portion on an opposing side of the manifold.

Element 4: further comprising a hermetic barrier positioned proximate an uphole end of the housing, the hermetic barrier having an electrical feedthrough and configured to maintain vacuum pressure or gas fill pressure within the apparatus.

Element 5: wherein the housing includes a first port at an uphole end and a second port at a downhole end.

Element 6: wherein a plug connects with the second port, the plug having a screen.

Element 7: further comprising a fourth sensor positioned within the housing.

Element 8: wherein the fourth sensor is a second downhole hydraulic device pressure sensor.

Element 9: wherein the fourth sensor is not configured to measure pressure and/or temperature.

Element 10: wherein the removable downhole tool includes an electronics subassembly.

Element 11: wherein the multi-sensor apparatus is coupled with the electronics subassembly by a connector at an uphole end of the housing.

Element 12: further comprising receiving the multi-sensor apparatus uphole of the wellbore and reconfiguring the multi-sensor apparatus for use in another downhole application.

Element 13: wherein the multi-sensor apparatus is coupled with the one or more downhole tools by bendable tubing.

Element 14: wherein the multi-sensor apparatus is coupled with the one or more downhole tools by bendable tubing.

Element 15: wherein the multi-sensor apparatus is coupled with an external hydraulic manifold.

Element 16: wherein the one or more downhole tools include at least a first hydraulic device.

Those skilled in the art to which this application relates will appreciate that other and further additions, deletions, substitutions and modifications may be made to the described embodiments.

What is claimed is:

1. An apparatus for use in a wellbore, comprising:

a manifold, the manifold having a plurality of ports;

a housing connected with the manifold, wherein the housing includes at least a first portion coupled on one side of the manifold and a second portion coupled on an opposing longitudinal side of the manifold;

at least three sensors positioned within the housing; and a first internal channel and a second internal channel for enabling fluid flow through the manifold.

2. The apparatus according to claim 1, wherein the housing further includes a third portion coupled with either the first portion or second portion, and wherein the at least three sensors include a tubing pressure sensor, an annulus pressure sensor, and a first downhole hydraulic device pressure sensor, wherein each pressure sensor is positioned in one of the first, second, and third portions of the housing.

3. The apparatus according to claim 1, wherein the first internal channel connects two or more of the plurality of ports with a first sensor of the at least three sensors and the second internal channel connects two or more of the plurality of ports with a second sensor of the at least three sensors.

4. The apparatus according to claim 1, further comprising a hermetic barrier positioned proximate an uphole end of the housing, the hermetic barrier having an electrical feedthrough and configured to maintain vacuum pressure or gas fill pressure within the apparatus.

5. The apparatus according to claim 1, wherein the housing includes a first port at an uphole end and a second port at a downhole end.

6. The apparatus according to claim 5, wherein a plug connects with the second port, the plug having a screen.

7. The apparatus according to claim 1, further comprising a fourth sensor positioned within the housing.

8. The apparatus according to claim 7, wherein the fourth sensor is a second downhole hydraulic device pressure sensor.

9. The apparatus according to claim 7, wherein the fourth sensor is not configured to measure pressure and/or temperature.

10. A system, comprising:

a removable downhole tool to be run into a wellbore extending through one or more subterranean formations; and a multi-sensor apparatus coupled with the removable downhole tool, the multi-sensor apparatus including:

a manifold, the manifold having a plurality of ports;

a housing connected with the manifold, wherein the housing includes at least a first portion coupled on one side of the manifold and a second portion coupled on an opposing longitudinal side of the manifold;

at least three sensors positioned within the housing; and a first internal channel and a second internal channel for enabling fluid flow through the manifold.

11. The system according to claim 10, wherein the removable downhole tool includes an electronics subassembly.

12. The system according to claim 11, wherein the multi-sensor apparatus is coupled with the electronics subassembly by a connector at an uphole end of the housing.

13. The system according to claim 10, wherein the at least three sensors include a tubing pressure sensor, an annulus pressure sensor, and a first downhole hydraulic device pressure sensor.

14. The system according to claim 10, further comprising a hermetic barrier positioned proximate an uphole end of the housing of the multi-sensor apparatus, the hermetic barrier having an electrical feedthrough and configured to maintain vacuum pressure within the multi-sensor apparatus.

15. The system according to claim 10, wherein the multi-sensor apparatus includes at least a fourth sensor.

16. A method, comprising:

preparing a completion tool for placement into a wellbore extending through one or more subterranean formations, the completion tool including a removable tool;

coupling a multi-sensor apparatus with the completion tool, the multi-sensor apparatus including:

a manifold, the manifold having a plurality of ports;

a housing connected with the manifold, wherein the housing includes at least a first portion coupled on one side of the manifold and a second portion coupled on an opposing longitudinal side of the manifold;

at least three sensors positioned within the housing; and a first internal channel and a second internal channel for enabling fluid flow through the manifold;

monitoring, by the multi-sensor apparatus, one or more downhole tools in the wellbore;

receiving at least one command from a control unit to set the one or more downhole tools; and removing the removable tool and multi-sensor assembly from the wellbore.

17. The method according to claim 16, further comprising receiving the multi-sensor apparatus uphole of the wellbore and reconfiguring the multi-sensor apparatus for use in another downhole application.

18. The method according to claim 16, wherein the multi-sensor apparatus is coupled with the one or more downhole tools by bendable tubing.

19. The method according to claim 16, wherein the completion tool is coupled with a lower completion system while being placed into the wellbore.

* * * * *